US005667444A

United States Patent [19]

Caballero

[11] Patent Number: 5,667,444

[45] Date of Patent: Sep. 16, 1997

[54] SPORTS FLOORING

[76] Inventor: Josep Lluis Mencheta Caballero, Avenida Peris y Valero, 162-B, E-46006, Valencia, Spain

[21] Appl. No.: 600,943

[22] PCT Filed: Jun. 20, 1995

[86] PCT No.: PCT/ES95/00076

§ 371 Date: Feb. 21, 1996

§ 102(e) Date: Feb. 21, 1996

[87] PCT Pub. No.: WO95/35423

PCT Pub. Date: Dec. 28, 1995

[30] Foreign Application Priority Data

Jun. 21, 1994 [ES] Spain ..... P9401355

[51] Int. Cl.[6] ..... A63C 19/04

[52] U.S. Cl. ..... 472/92; 52/393

[58] Field of Search ..... 472/92, 88, 89, 472/85; 404/32; 52/403.1, 393; 428/17, 95, 326, 340

[56] References Cited

U.S. PATENT DOCUMENTS

| | | | |
|---|---|---|---|
| 4,307,879 | 12/1981 | McMahon et al. | 472/85 |
| 4,650,180 | 3/1987 | Blondel | 472/92 |
| 5,183,438 | 2/1993 | Blom | 472/92 |

*Primary Examiner*—Kien T. Nguyen
*Attorney, Agent, or Firm*—J. Sanchelima

[57] ABSTRACT

Improved sports flooring for practicing sports indoor as in sports halls, for example basketball, football, handball, volleyball, etc. It has improved biomechanical characteristics and the vertical bouncing height is higher than 90%, having also a friction coefficient appropriate to run and rotate rapidly. It is comprised of a double-panel marine (quality) plywood (1,3) joined to each other with angle offset of 45°. Elements or feet (2) made of rubber or the like, in contact with the ground, are added or stapled to the lower panel (1). On the visible face of the second marine panel (3) is applied a layer of glue for lying sticking the agglomerated cork sheets (4), in a joined configuration. Finally, two varnish layers (5) are applied.

1 Claim, 1 Drawing Sheet

SPORTS FLOORING

OBJECTIVE OF THE INVENTION

The present invention, as the title of these specifications discloses, relates to an improved sports flooring (pavement), that brings several functional and practical advantages over products that exist in today's market.

This new pavement, for indoor applications, uses as main material pressed cork, with the following advantages:

The final product cost is less than the present ones.

It is a highly natural and ecological product because the amount of material necessary is much less than the rest of floorings.

It is an excellent thermic isolator and acoustic corrector.

It provides an optimum isolator of vibrations, as well as a very high mechanical resistance.

Humidity practically does not alter its structure nor its dimensional stability.

It has a high index of incombustibility, as well as a high resistance to chemical agents, parasites and microorganisms.

Its main component, (pressed cork), abounds in Spain, since it is one of the main producing countries.

Its life is considerably greater that other floorings, requiring once installed, minimum maintenance that would be reduced to varnishing and sandpapering processes with a minimum frequency.

A sports flooring must be conceived to be used depending on the sports to be practiced on it. The type of sports and its rules delimitate the characteristics, known as "federal" or "by regulations", such as dimensions, ball bounce, etc.. These requirements are created by the sports normative tradition and the sports accessories used, such as balls, goals, pole, etc. But once these minimal requirements are overcome, it is necessary that the flooring be adapted to a sportsperson, helping to improve his/her yield and protecting the user from possible lesions. The latter ones being the biomechanical characteristics of the pavement.

Of course, there are construction normative requirements regarding durability and maintenance. The proposed pavement is used indoors as in sports halls, for example basketball, football, volleyball etc..

The most important requirement is the vertical bouncing height of the ball.

The most important biomechanical characteristics that should be taken into consideration are impact amortization and friction between shoes and ground.

BACKGROUND ART

At the present time the sports floorings used are those comprising several wood elements, glued, joined, or assembled to each other.

These pavements reach a high price and require cutting a considerable number of trees for their manufacture. Also, wooden pavements are susceptible to the humidity, highly combustible and their biomechanical characteristics, (impact absorption, shoe friction, ground etc.), are not acceptable.

On the other hand, the bouncing of a ball in these kind of pavements rarely reaches 90% of the ball bouncing height that require different federal international organizations.

DESCRIPTION OF THE INVENTION

The improved sports flooring, subject of the invention, overcomes all the previously mentioned inconveniences, constituting a technical solution, with an interesting future expectation because it optimizes ideal specifications that must be taken in consideration to define the quality of a sports flooring with the characteristics in question.

In general terms, the structure of the improved sports flooring disclosed herein, is defined by the combination of a double-panel marine (quality) plywood, multilayer and preferably having 24 millimeters of thickness with agglomerated and pressed panels of cork with approximate 550 kg/m$^3$ of density, two films of varnish is given to the upper surface and the whole structure of panel and layers is supported by feet made of cork or rubber material that isolate the flooring from the ground.

The cork elements are nailed to one of the marine plywood panel, specifically to the lower one, and the second marine plywood panel is placed adjacent and glued to the first panel with the particularity of having an angled offset of 45°. This combination of panels is rigidly stapled and glued.

After that, a layer of glue is applied to the second marine plywood panel and proceed with the setting of the cork plates, which are disposed in interlock manner.

Finally two layers of varnish are applied and dried, finishing the structure and configuration of the new flooring.

If desired, to simplify the mounting of the flooring, it is possible to omit the lower first marine plywood panel, being substituted by screed boards that will provide the support for the group on the ground.

To facilitate the best understanding of the characteristics of the present invention and forming part of this description, one page of drawings is accompanied with, wherein detailed description is for the purpose of fully disclosing the invention without placing limitations thereon.

DESCRIPTION OF THE PREFERRED EMBODIMENT

Referring now to the numerals adopted in the figures, we can see how the sports flooring includes first panel of marine plywood multilayers 1, leaning on the ground through feet or supports made out of cork, rubber or similar (material) 2, being these elements 2 mounted to panel 1, by gluing or stapling them preferably.

Figure 1:
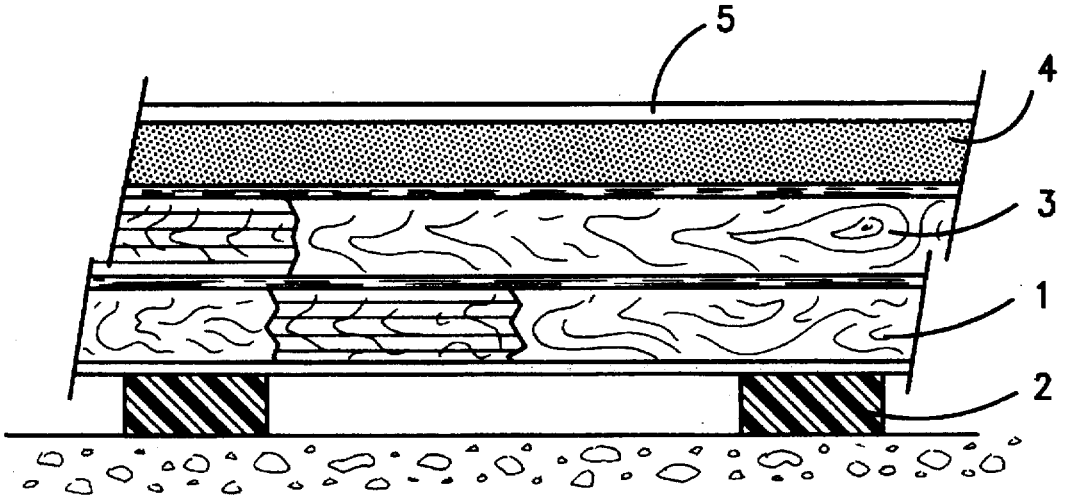
FIG. 1 is an schematic representation of a partial cross section, showing the different layers of a sports flooring or pavement, in accordance with the invention.
Figure 2:
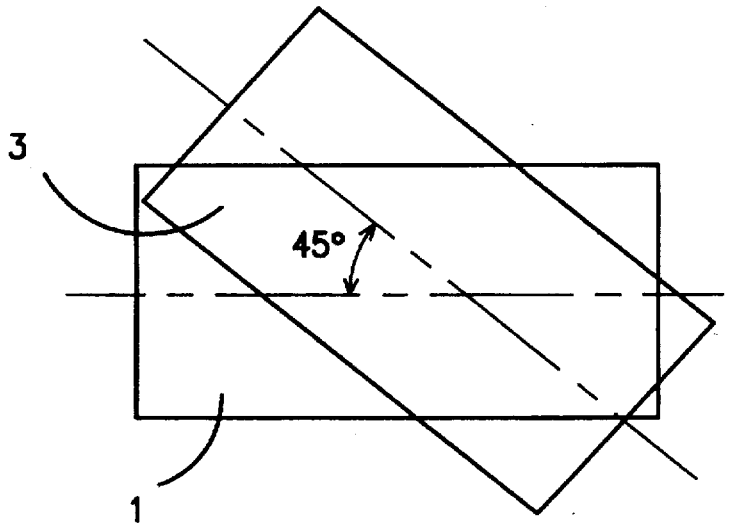
FIG. 2 is an schematic top view, showing an angular offset of marine plywood panels.

As shown in FIG. 2, over first panel 1 and 3 at angle offset of 45°, the second marine plywood panel 3 is stapled and glued.

The reference (numeral) 4 refers to the pressed and agglomerated sheet, having a density of approximately 550 kg/m$^3$, as we had previously indicated.

Finally two layers of varnish are applied to finalize the pavement or sports flooring. The varnish layers is referred to with numeral 5.

I claim:

1. In a sports flooring for practicing indoor sports in sports halls, such as basketball, football, volleyball, wherein the biomechanical characteristics of the flooring are important and the bouncing height of said flooring is higher than 90% with frictional coefficient suitable for playing said sports safely, and said flooring comprising:

A) first and second plywood panels joined to each with an offset angle of approximately 45 degrees, and said joined first and second plywood panels having an underside and an upperside, B) a plurality of feet members mounted to said underside and said feet members being made out of rubber;

C) a cork panel having first and second surfaces, said first surface being mounted over said upperside and said cork panel having an approximate density of 550 $Kg./m^3$;

D) at least two layers of varnish applied to the other surface of said cork panel.

* * * * *